US006881112B2

(12) United States Patent
Kunz et al.

(10) Patent No.: US 6,881,112 B2
(45) Date of Patent: Apr. 19, 2005

(54) STROKE CYCLE PHASE SHIFT ROWING

(76) Inventors: Charles O. Kunz, 1130 Eastern Ave., Ballston Lk., NY (US) 12019; Nancy M. Kunz, 487 Henry St., Brooklyn, NY (US) 11231

( * ) Notice: Subject to any disclaimer, the term of this patent is extended or adjusted under 35 U.S.C. 154(b) by 0 days.

(21) Appl. No.: 10/376,396

(22) Filed: Mar. 3, 2003

(65) Prior Publication Data

US 2004/0175999 A1 Sep. 9, 2004

(51) Int. Cl.[7] ..... B63H 16/06
(52) U.S. Cl. ..... 440/104; 440/106; 114/343
(58) Field of Search ..... 114/364, 343, 114/347, 363; 440/101–110; 416/70 R, 74

(56) References Cited

U.S. PATENT DOCUMENTS

| | | | | | |
|---|---|---|---|---|---|
| 918,994 | A | * | 4/1909 | Gallaher et al. | 4/487 |
| 4,411,214 | A | * | 10/1983 | Horiuchi | 114/347 |
| 4,889,509 | A | * | 12/1989 | Pohlus | 440/105 |
| 5,016,557 | A | * | 5/1991 | Miller | 114/347 |
| 5,067,426 | A | * | 11/1991 | Vespoli et al. | 114/61.3 |
| 5,188,048 | A | * | 2/1993 | Vespoli et al. | 114/61.3 |
| 5,279,239 | A | * | 1/1994 | Vespoli et al. | 114/61.27 |
| 5,421,285 | A | * | 6/1995 | Shaper | 114/363 |
| 5,474,008 | A | * | 12/1995 | Vespoli et al. | 114/56.1 |

FOREIGN PATENT DOCUMENTS

| | | | | |
|---|---|---|---|---|
| JP | 61030491 A | * | 2/1986 | B63H/16/067 |
| SU | 796078 B | * | 1/1981 | B63H/16/00 |

* cited by examiner

*Primary Examiner*—S. Joseph Morano
*Assistant Examiner*—Ajay Vasudeva

(57) ABSTRACT

A rowing shell adapted for phase shift rowing, seating multiple groups of rowers such that all rowers within a group are seated for synchronous rowing, but each group is seated for asynchronous rowing with respect to the adjacent group. The phase shift rowing overcomes deficiencies encountered In boats supporting unison rowing, and provides greater average velocity for the same power input. The spacing provided between adjacent groups of rowers rowing out of phase is approximately twice or greater than the spacing between adjacent rowers rowing in phase within each group, wherein the spacing is defined by the distance between adjacent oarlock pins.

5 Claims, 4 Drawing Sheets

STROKE CYCLE PHASE SHIFT ROWING

BACKGROUND

In competitive rowing in sweep rowing shells and sculling shells with more than one rower, the rowers train so that they all execute the stroke in unison. The rowers are evenly spaced to provide enough room for sliding back and forth on the slides and rowing without impeding one another. Typical spacing from oarlock pin to oarlock pin measured along the lengthwise axis of the boat for adjacent rowers is 1.4 m. Rowing a boat in unison results in considerable variation in the boat's velocity during each stroke. It has been determined that a boat's velocity ranges from about 25% greater than the average velocity to about 25% less than the average velocity during each stroke cycle and the time averaged velocity is approximately 12% greater than the average velocity half of the time and approximately 12% less than the average velocity half of the time. ("The FISA Coaching Development Programming Course", Level 1 Handbook (revised 1990), Section 3, page 3, editors Thor Nilsen, Ted Daigneault and Matt Smith). The resistance for moving a boat through the water is approximately proportional to the velocity of the boat squared and the power required to maintain a particular velocity is approximately proportional to the boat's velocity cubed ("Physics of Rowing," Dr. A. Dudhia, Department of Atmospheric Physics, Oxford University, dudhia@atm.ox.uk). Therefore, it requires approximately 4% less power to propel a boat at a constant velocity (Vc) than for a boat with the velocity half of the time at 12% greater than Vc and half of the time at 12% less than Vc, if all other factors remain the same. This patent describes a method for rowing boats with two, four, or eight rowers to reduce the stroke cycle velocity variation and thereby to increase the velocity/power efficiency. The patent also describes changes in boat design to facilitate rowing in a manner to reduce the stroke cycle velocity variation.

The method described in this patent is referred to as stroke cycle phase shift rowing. Boat designs are specified to facilitate individual rowers or groups of rowers, rowing out of phase with other individual rowers or groups of rowers. Phase shift rowing, previously referred to as syncopated rowing or multicycle rowing, was mentioned in the "Textbook of Oarsmanship" by Gilbert Bourne (1925). Bourne states that, "Mathematicians frequently assure me that, if only we could rig out and train a crew that one pair of oars was always at work, the boat would go much faster. An oarsman can only plead his experience in mitigation of his ignorance of mathematics and say politely that he is quite sure it would not." In "The Story of World Rowing" by Christopher Dodd (1992) the author notes that syncopated rowing was tried by F.E. "Two legs" Hellyer in the 1930s at the London Rowing Club using six men in an eight and that it failed. Other references and trials similarly indicate that syncopated rowing was tried and that it failed. Employing the designs and methods for phase shift rowing described in this patent will increase the velocity/power efficiency for rowing shells with slideable seats and will result in faster boats in competitive rowing.

SUMMARY

In sweep rowing shells and sculling shells with two, four, or eight rowers a method for rowing is proposed to reduce the stroke cycle velocity variation from that obtained when two, four, or eight rowers, row in unison. When rowing in unison or in phase, all members of a crew execute all elements of each stroke together. Rowing in unison results in considerable variation in the boat's velocity during each stroke. To reduce the stroke cycle velocity variation and thereby to increase the velocity/power efficiency, we propose that individuals or groups of individuals row out of phase with other individuals or groups of individuals comprising the crew of a boat. Rowing out of phase requires that individuals or groups of crew members execute all elements of each stroke at different times than other individuals or groups of crew members during each stroke cycle. We refer to this method of rowing as stroke cycle phase shift rowing. Changes in boat design are also proposed to facilitate stroke cycle phase shift rowing. In boats with unison rowing the rowers are evenly spaced with about 1.4 m separating adjacent rowers. To facilitate stroke cycle phase shift rowing, individuals or groups of individuals in a crew are spaced further apart than the spacing for adjacent rowers rowing in unison. Examples of stroke cycle phase shift rowing indicating oar positioning and rower spacing are given for eights with sweep rowing, fours with sweep rowing, sculling quads and sculling doubles. For eights with sweep rowing, fours with sweep rowing and sculling quads; examples are given for one-half stroke cycle phase shift rowing and one-quarter stroke cycle phase shift rowing. For sculling doubles, an example is given for one-half stroke cycle phase shift rowing. The objective of stroke cycle phase shift rowing is to reduce the stroke cycle velocity variation relative to unison (in phase) rowing and to thereby obtain a greater average velocity for the same power input.

DESCRIPTION OF THE INVENTION

The method for rowing sweep rowing shells and sculling shells with stroke cycle phase shift rowing and the design of boats to facilitate stroke cycle phase shift rowing is described in eight examples for boats with two, four and eight rowers.

EXAMPLE 1

Figure 1:
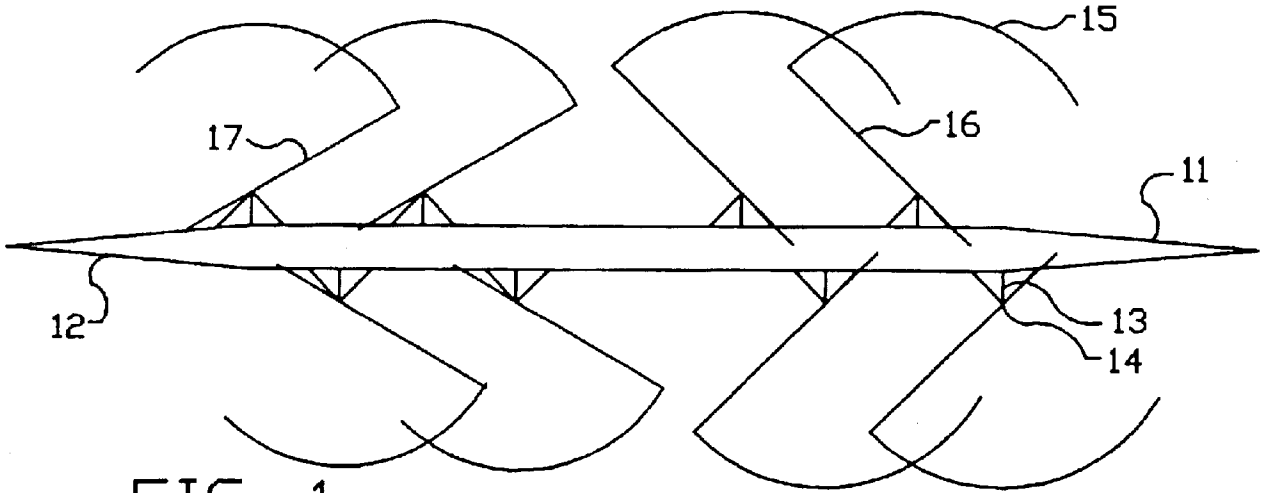
FIG. 1 is a top plan view of an eight person sweep rowing shell showing the outline of the shell, the location of the rigging and oar positions for a shell designed for two groups of four rowing with a one-half stroke cycle phase shift with alternate side rowing for adjacent rowers.

Eight Sweep With One-Half Stroke Cycle Phase Shift Rowing, Alternate Side Rowing for Adjacent Rowers In Example 1 an eight-person shell with sweep rowing is considered with references made to FIG. 1. Numbering the rowers from one to eight beginning at the bow 11 and ending at the stern 12, the rowers one through four are grouped together as the first four, and rowers five through eight are grouped together as the second four. The location of the rowers is indicated by the location of the rigging 13 for each rower and the spacing between adjacent rowers is the distance from oarlock pin to oarlock pin 14 measured parallel to the lengthwise axis of the boat. The oarlock pin 14 is located at the apex of the rigging 13. All adjacent rowers row on opposite sides of the boat. In constructing FIG. 1, typical values for a men's eight with sweep rowing have been used as follows: the spacing between adjacent rowers rowing in unison is 1.4 m, the outboard oar length is 2.68 m and the spread is 0.84 m. The length of the stroke is shown in FIG. 1 as a 105° arc 15 with an angle of 30° to the boat's lengthwise axis at the catch and an angle of 45° to the boat's axis at the finish. Measured arcs for the men's sweep rowing are about 90° with angles of 35° at the catch and 55° at the finish. Measured arcs for women's sweep rowing are about 80° with angles of 45° at the catch and 55° at the finish. A length of stroke with an arc of 105° 15 is shown in all figures of boats with sweep rowing in this specification to accommodate rowers that may employ a length of stroke greater than the average measured length of stroke. The spacing between the first and second four (rowers four and five) is increased to 3.5 m so that the rowers in one four can row at one-half of a stroke cycle out of phase with the other four. The relative positioning of the oars for the two groups of four rowing with a one-half stroke cycle phase shift is shown FIG. 1. The oars for rowers one through four are shown in the finish position 16 of a stroke and the oars for rowers five through eight are shown in the catch position 17 of a stroke. Adjacent rowers within each four are separated by 1.4 m and adjacent rowers row on opposite sides of the boat. Depending on factors such as oar length, spread and length of stroke, the separation of fours could be somewhat less than 3.5 m.

The magnitude of the force variation during each stroke cycle generated with half of the crew rowing at one-half of a stroke cycle out of phase with the other half will be approximately one-half of the force variation generated with all of the crew members rowing in unison. In addition, with one-half stroke cycle phase shift rowing, the time separating the maximum variations in force is reduced to one-half for the same rower stroke rate. The resistance for propelling the boat through the water is approximately proportional to the velocity squared, therefore a factor of 2 reduction in the magnitude of the force variation is expected to result in a factor of about 1.4 reduction in velocity variation. Decreasing the time period between force variations will also reduce the variation in velocity. Assuming a similar factor of 1.4 for reducing the velocity variation due to reducing the time period between force variations, a factor of about 2 could be obtained for reduction in stroke cycle velocity variation when a boat utilizes one-half stroke cycle phase shift rowing. For unison rowing, we will assume that the time averaged velocity is 12% greater than the average velocity half of the time and 12% less than the average velocity half of the time. Furthermore, assuming that with one-half stroke cycle phase shift rowing the time averaged velocity of the boat is 6% greater than the average velocity half of the time and 6% less than the average velocity half of the time, the power required to maintain the same average velocity is about 3% less for one-half stroke cycle phase shift rowing than for unison rowing, if all other factors remain the same.

To accommodate one-half stroke cycle phase shift rowing the boat must be longer, increasing the weight of the boat and increasing the drag or resistance to propel the boat through the water. Separating the two fours by 3.5 m would increase the length of the boat by 2.1 m. If a conventional eight is about 18m long and weighs about 100 kg, increasing the length 2.1 m could increase the weight by approximately 12 kg, In "Physics of Rowing" by A. Dudhia, it is estimated that adding 12 kg dead weight to an eight person boat would decrease the velocity by about 0.25% taking into account the increased drag It should be noted that the estimate for increased weight and resulting increased drag for a boat designed for one-half stroke cycle phase shift rowing is probably a maximum estimate. The load the boat must carry (crew, oars and remains the same. Therefore, a boat 12% longer could be narrowed by 12% and maintain the same buoyancy. Making boats narrower would reduce the weight increase and a narrower boat may have less drag. The estimate for the decrease in velocity of 0.25% resulting from increased weight is small relative to the potential increase in velocity obtained by reducing the stroke cycle velocity variation with one-half stroke cycle phase shift rowing. Recognizing that there may be increased drag for longer boats, the effect on velocity resulting from making boats longer to accommodate phase shift rowing will not be discussed in subsequent examples.

EXAMPLE 2

Figure 2:
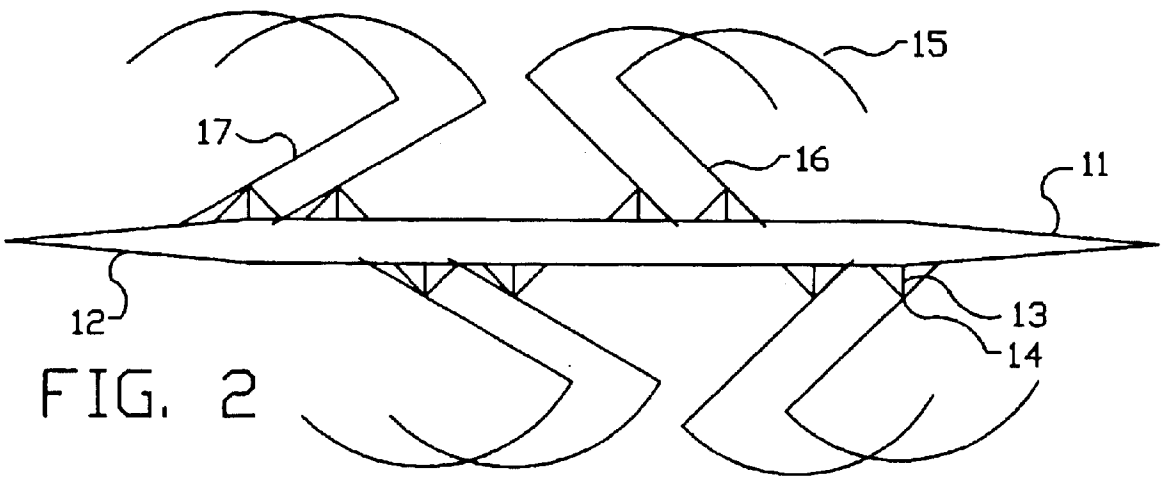
FIG. 2 is a top plan view of an eight person sweep rowing shell showing the outline of the shell, the location of the rigging and oar positions for a shell designed for two groups of four rowing with a one-half stroke cycle phase shift with same side rowing for adjacent pairs.

Eight Sweep With One-Half Stroke Cycle Phase Shift Rowing Same Side Rowing for Adjacent Pairs In Example 1, adjacent rowers row on opposite sides of the boat. In Example 2, one-half stroke cycle phase shift rowing for an eight person sweep is considered where adjacent pairs row on the same side of the boat. References for Example 2 are made to FIG. 2. The location of the rowers is indicated by the location of the rigging 13 for each rower and the spacing between adjacent rowers is the distance from oarlock pin to oarlock pin 14 measured parallel to the lengthwise axis of the boat. In constructing FIG. 2, typical values for a men's eight with sweep rowing have been used as follows: the spacing between adjacent rowers rowing in unison is 1.4 m, the outboard oar length is 2.68 m and the spread is 0.84 m. The length of stroke is a 105° arc 15 with an angle of 30° to the boat's lengthwise axis at the catch and an angle of 45° to the boat's axis at the finish. Numbering the rowers from one to eight beginning at the bow 11 and ending at the stern 12, if rowers one and two row on the starboard side, rowers three and four row port, rowers five and six row starboard, and rowers seven and eight row port. Rowers one through four row in unison and constitute the first four. Rowers five through eight constitute the second four and row at one-half of a stroke cycle out of phase with the first four. Rowers within a four are spaced about 1.4 m apart. To accommodate one-half stroke cycle phase shift rowing, the separation between the two fours (rowers four and five) is increased to 2.1 m. The relative positioning of the oars for the two groups of four rowing with a one-half stroke cycle phase shift is shown in FIG. 2. The oars for rowers one through four are shown in the finish position 16 of a stroke and the oars for rowers five through eight are shown in the catch position 17 of a stroke. Depending on factors such as oar length, spread and length of stroke, the separation of the two fours could be somewhat less or greater than 2.1 m. A decrease in stroke cycle velocity variation similar to that obtained in Example 1 is expected for Example 2.

EXAMPLE 3

Eight Sweep, One-Quarter Stroke Cycle Phase Shift Rowing

Figure 3:
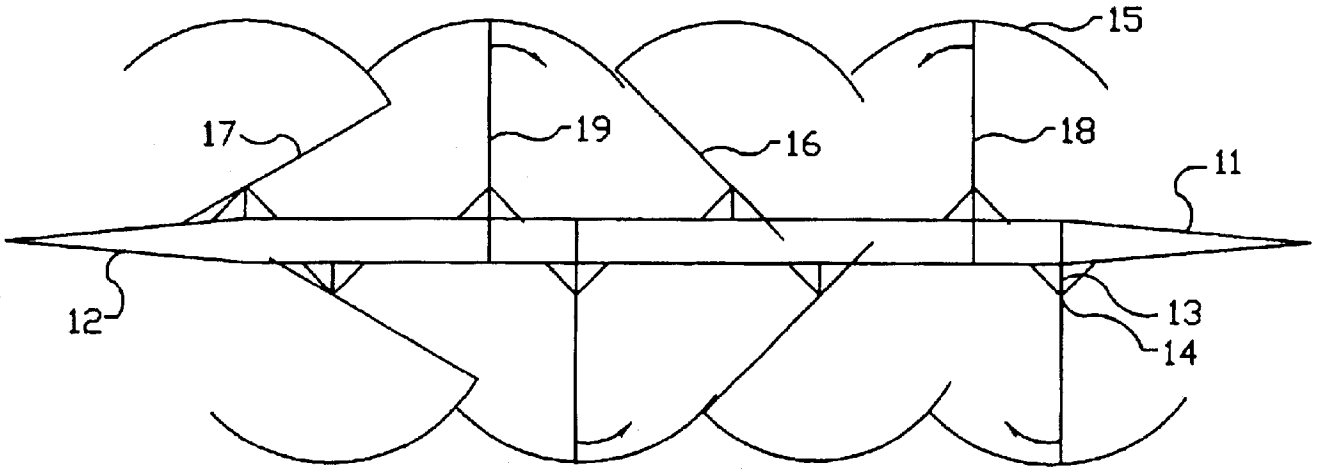
FIG. 3 is a top plan view of an eight person sweep rowing shell showing the outline of the shell, the location of the rigging and oar positions for a shell designed for four pairs rowing with a one-quarter stroke cycle phase shift.

For the third example, an eight-person sweep designed for one-quarter stroke cycle phase shift rowing is considered. References for Example 3 are made to FIG. 3. The location of the rowers is indicated by the location of the rigging 13 for each rower and the spacing between adjacent rowers is the distance from oarlock pin to oarlock pin 14 measured parallel to the lengthwise axis of the boat. In constructing FIG. 3, typical values for a men's eight with sweep rowing have been used as follows: the spacing between adjacent rowers rowing in unison is 1.4 m, the outboard oar length is 2.68 m and the spread is 0.84 m. The length of stroke is a 105° arc 15 with an angle of 30° to the boat's lengthwise axis at the catch and an angle of 45° to the boat's axis at the finish. Numbering the rowers from bow 11 to stern 12 as rowers one through eight, the one and two rowers are the first pair, the three and four rowers are the second pair, the five and six rowers are the third pair and the seven and eight rowers are the fourth pair. The boat design for one-quarter stroke cycle phase shift rowing increases the spacing between the pairs of rowers, i.e. between the first and second pair, between the second and third pair and between the third and fourth pair to make it possible for the second pair to row at one-quarter of a stroke behind (or before) the first pair, the third pair at one-quarter stroke behind (or before) the second pair and the fourth pair at one-quarter stroke behind (or before) the third pair. A suggested spacing of rowers and relative oar positions are shown in FIG. 3. The spacing between the members of a pair (rowers one and two, three and four, five and six, seven and eight) is left at 1.4 m and the spacing between the first and second pair, the second and third pair and the third and fourth pair is increased to 2.5 m. The spacing between pairs, oar length, spread and length of a stroke must be such that adjacent pairs can row at one-quarter stroke out of phase without the oars of one pair obstructing the oars of an adjacent pair. The spacing between pairs may be somewhat less or greater than 2.5 m and will depend in part on the ability of a crew to maintain a one-quarter-stroke phase shift between adjacent pairs. In FIG. 3, the position of the oars for the first pair of rowers is shown in the power position 18, the oars for the second pair are shown in the finish position 16, the oars for the third pair are shown in the recovery position 19 and the oars for the fourth pair are shown in the catch position 17. With one-quarter stroke cycle phase shift rowing, the net force generated to propel the boat forward is nearly constant which would result in a nearly constant velocity for the boat. For the same power input, a boat propelled with constant velocity will be faster than boats with unison rowing and one-half stroke cycle phase shift rowing if all other factors, such as drag, remain the same.

EXAMPLE 4

Four Sweep, One-Half Stroke Cycle Phase Shift Rowing

Figure 4:
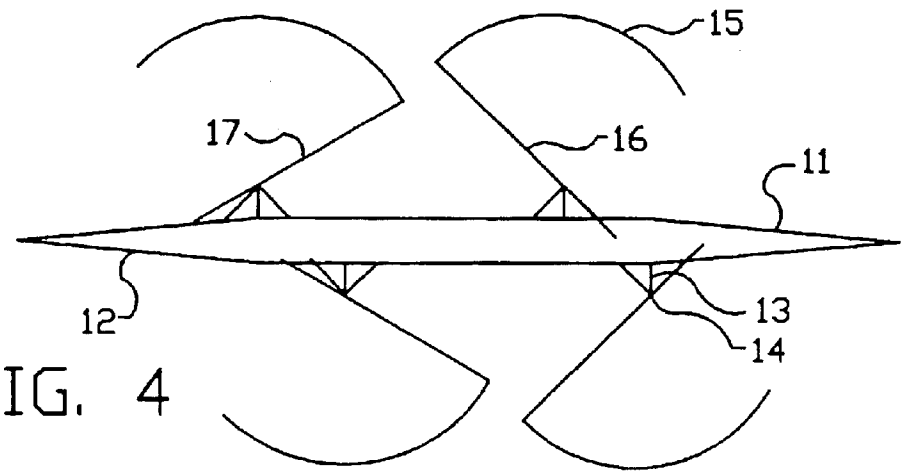
FIG. 4 is a top plan view of a four person sweep rowing shell showing the outline of the shell, the location of the rigging and oar positions for a shell designed for two pairs rowing with a one-half stroke cycle phase shift.

In a four-person boat with sweep rowing, the force pattern generated by the rowers rowing in unison will be similar to the force pattern generated by an eight-person boat with unison rowing. The magnitude or amplitude of the forces for a four will be about one-half of the forces for an eight. The time period of the forces is approximately the same. Since a four is about one-half the weight of an eight, the velocity of a four is about the same as an eight (fours average about 7% slower than eights). References for Example 4 are made to FIG. 4. The location of the rowers is indicated by the locations of the rigging 13 for each rower and the spacing between adjacent rowers is the distance from oarlock pin to oarlock pin 14 measured parallel to the lengthwise axis of the boat. In constructing FIG. 4, typical values for a men's four with sweep rowing have been used as follows: the spacing between adjacent rowers rowing in unison is 1.4 m, the outboard oar length is 2.66 m and the spread is 0.86 m. The length of stroke is a 105° arc 15 with an angle of 30° to the boat's lengthwise axis at the catch and an angle of 45° to the boat's axis at the finish. For one-half stroke cycle phase shift rowing for a four with sweep rowing, the crew is divided into two pairs. Numbering the rowers one through four beginning at the bow 11 and ending at the stern, 12 rowers one and two are grouped as the first pair and rowers three and four are grouped as the second pair. The distance between the rowers within a pair (rowers one and two and rowers three and four) is 1.4 m. In the example shown in FIG. 4, the distance between the two pairs (rowers two and three) is increased to 3.5 m to facilitate one-half stroke cycle phase shift rowing. Depending on factors such as oar length, spread and length of stroke, the spacing between the two pairs of rowers can be adjusted to somewhat less than 3.5 m. The relative positioning of the oars for the two pairs rowing with a one-half stroke cycle phase shift is shown in FIG. 4. The oars for the first pair are shown in the finish position 16 of a stroke and the oars for the second pair are shown in the catch position 17 of a stroke. As discussed for eights with one-half stroke cycle phase shift rowing, the magnitude of the force variations and the period between force variations for a four will be reduced by approximately one-half with one-half stroke cycle phase shift rowing in comparison to unison rowing. Also, as discussed for eights, the stroke cycle velocity variation for a four with one-half stroke cycle phase shift rowing will be less in comparison to unison rowing.

EXAMPLE 5

Four Sweep, One Quarter Stroke Cycle Phase Shift Rowing

Figure 5:
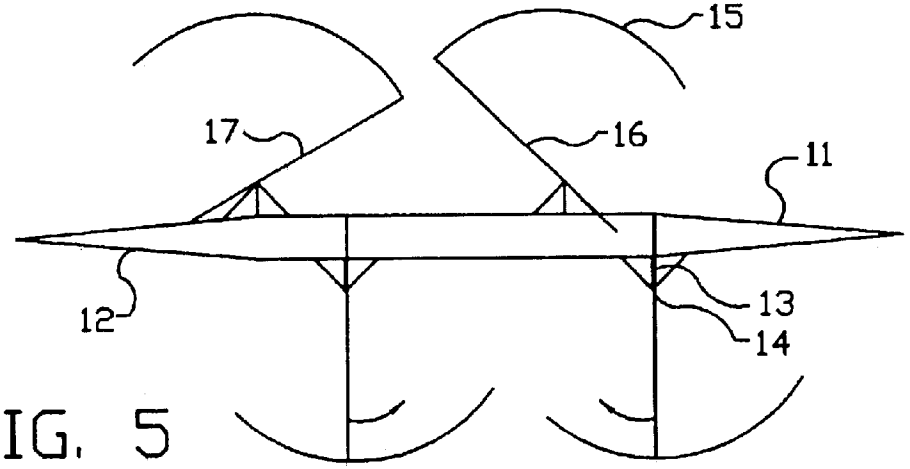
FIG. 5 is a top plan view of a four person sweep rowing shell showing the outline of the shell, the location of the rigging and oar positions for a shell designed for each rower rowing with a one-quarter stroke cycle phase shift.

References for Example 5 are made to FIG. 5. It is possible for a four with sweep rowing to be rowed with one-quarter stroke cycle phase shift rowing using the same boat designed for one-half stroke cycle phase shift rowing. In a four sweep with one-quarter stroke cycle phase shift rowing, each rower rows at one-quarter of a stroke cycle out of phase with the adjacent rowers or rower. The location of the rowers is indicated by the location of the rigging 13 for each rower and the spacing between adjacent rowers is the distance from oarlock pin to oarlock pin 14 measured parallel to the lengthwise axis of the boat. In constructing FIG. 5, typical values for a men's four with sweep rowing have been used as follows: the outboard oar length is 2.66 m and the spread is 0.86 m. The length of stroke is a 105° arc 15 with an angle of 30° to the boat's lengthwise axis at the catch and an angle of 45° to the boat's axis at the finish. Numbering the rowers from one to four beginning at the bow 11 and ending at the stern 12, the number two rower rows at one-quarter of a stroke cycle before (or after) the number one rower, the number three rower is one-quarter of a stroke cycle before (or after) the number two rower and the number four rower is one-quarter of a stroke cycle before (or after) the number three rower. In FIG. 5, the relative positioning of the oars are shown with the number one rower in the power position 18, the number two rower in the finish position 16, the number three rower in the recovery position 19 and the number four rower in the catch position 17. To facilitate one-quarter stroke cycle phase shift rowing in a four sweep the separation between the number two and number three rowers is increased to 3.5 m. The separation between the one and two rowers and the three and four rowers is 1.4 m, which is a typical value for rower separation in a four sweep shell with unison rowing. Depending on factors such as oar length, spread and length of stroke, the separation between rowers two and three could be adjusted to somewhat greater or less than 3.5 m. It will be difficult for a crew to maintain one-quarter phase shift rowing, however, it should result in a nearly constant velocity for the boat as discussed for eights with one-quarter phase shift rowing. For a four sweep with one-quarter phase shift rowing, it will be more difficult to maintain equal power distribution on the port and starboard sides of the boat during each stroke cycle. Uneven power input during the stroke cycle on the port and starboard sides of the boat can result in a wobble in the boat's forward direction.

EXAMPLE 6

Quad Sculling, One-Half Stroke Cycle Phase Shift Rowing

Figure 6:
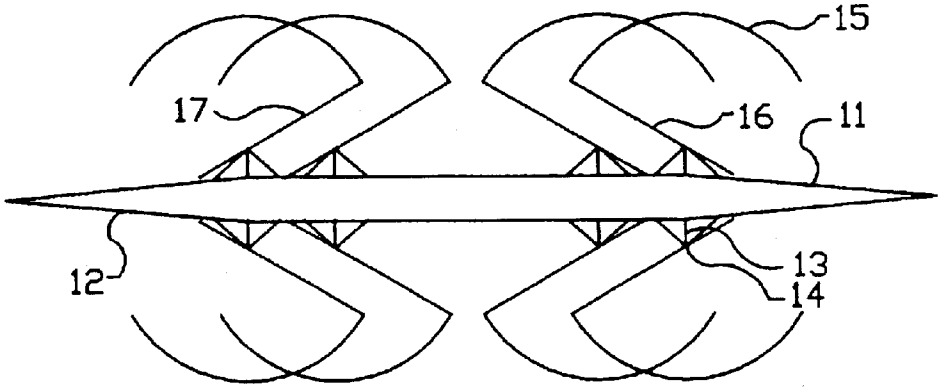
FIG. 6 is a top plan view of a quad sculling shell showing the outline of the shell, the location of the rigging and oar positions for a shell designed for two pairs rowing with a one-half stroke cycle phase shift.

References for Example 6 are made to FIG. 6. In sculling rowing, each rower has a port and starboard oar. In FIG. 6, the location of the rowers is indicated by the location of the rigging 13 for each rower and the spacing between adjacent rowers is the distance from oarlock pin to oarlock pin 14 measured parallel to the lengthwise axis of the boat. In constructing FIG. 6, typical values for a men's sculling quad have been used as follows: the spacing between adjacent rowers rowing in unison is 1.4 m, the outboard oar length is 2.11 m and the spread is 0.79 m. The length of the stroke is shown in FIG. 1 as a 120° arc 15 with an angle of 30° to the boat's lengthwise axis at the catch and an angle of 30° to the boat's axis at the finish. Measured arcs for men's sculling rowing are about 107° with angles of 30° at the catch and 43° at the finish. Measured arcs for women's sculling rowing are about 100° with angles of 37° at the catch and 43° at the finish. A length of stroke with an arc of 120° 15 is shown in all figures of boats with sculling rowing in this specification to accommodate rowers that may employ a length of stroke greater than the average measured length of stroke. For a sculling quad with one-half stroke cycle phase shift rowing, the rowers are divided into two pairs. Numbering the rowers from one to four beginning at the bow 11 and ending at the stern 12, rowers one and two are the first pair and rowers three and four are the second pair. For one-half stroke cycle phase shift rowing, the second pair rows at one-half of a stroke cycle out of phase with the first pair. To facilitate one-half stroke cycle phase shift rowing, the two pairs (rowers two and three) are spaced 4.2 m apart. The rowers within each pair, rowers one and two and rowers three and four are spaced 1.4 m apart. For one-half stroke cycle phase shift rowing, the relative positioning of the oars are shown in FIG. 6 with the oars of the first pair in the finish position 16 of a stroke and the oars of the second pair in the catch position 17 of a stroke. Depending on factors such as oar length, spread and length of stroke, the separation between rowers two and three could be adjusted to somewhat less than 4.2 m.

EXAMPLE 7

Quad Sculling, One Quarter Stroke Cycle Phase Shift Rowing

Figure 7:
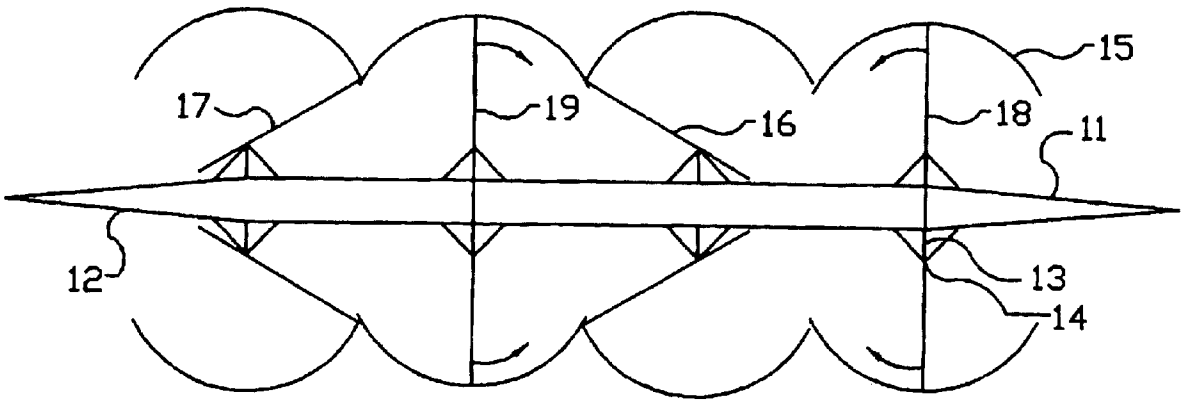
FIG. 7 is a top plan view of a quad sculling shell showing the outline of the shell, the location of the rigging and oar positions for a shell designed for each rower rowing with a one-quarter stroke cycle phase shift.

References for Example 7 are made to FIG. 7. A sculling quad can be rowed with one-quarter stroke cycle phase shift rowing as shown in FIG. 7. The location of the rowers is indicated by the location of the rigging 13 for each rower and the spacing between adjacent rowers is the distance from oarlock pin to oarlock pin 14 measured parallel to the lengthwise axis of the boat. In constructing FIG. 7, typical values for a men's sculling quad have been used as follows: the outboard oar length is 2.11 m and the spread is 0.79 m. The length of stroke is a 120° arc 15 with and angle of 30° to the boat's lengthwise axis at the catch and an angle of 30° to the boat's axis at the finish. The spacing between each rower is about 1.4 m in sculling quads with unison rowing. To facilitate one-quarter stroke cycle phase shift rowing, the spacing between each rower is increased to 3.6 m. Numbering the rowers from one to four beginning at the bow 11 and ending at the stern 12, the relative positioning of the oars for one-quarter stroke cycle phase shift rowing is shown in FIG. 7 with the one rower in the power position 18 of a stroke, the two rower in the finish position 16 of a stroke, the three rower in the recover position 19 of a stroke and the four rower in the catch position 17 of a stroke. The separation of rowers to facilitate one-quarter stroke cycle phase shift rowing in a sculling quad could be adjusted to somewhat greater or less than 3.6 m depending on factors such as oar length, spread and length of stroke. In addition, the ability of crew members to maintain a one-quarter stroke cycle phase shift with adjacent rowers will affect rower spacing. The net force propelling the boat forward will be nearly constant with one-quarter-stroke cycle phase shift rowing resulting in nearly constant velocity for the boat. With the same power input, a boat with constant velocity will have a greater average velocity than boats with variable stroke cycle velocity if all other factors are the same.

EXAMPLE 8

Pair Sculling, One-Half Stroke Cycle Phase Shift Rowing

Figure 8:
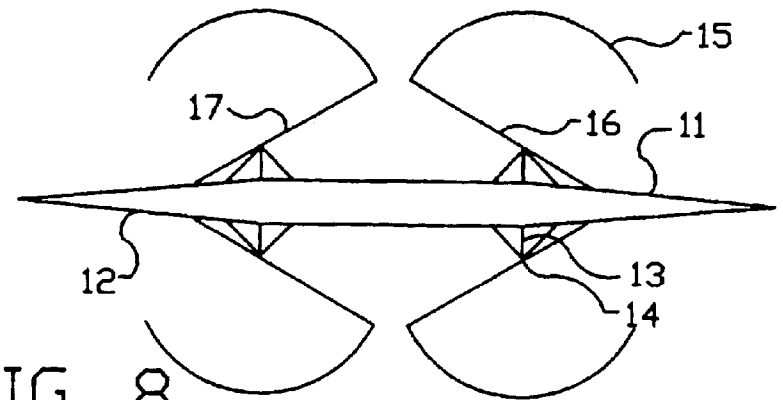
FIG. 8 is a top plan view of a double sculling shell showing the outline of the shell, the location of the rigging and oar positions for a shell designed for each rower rowing with a one-half stroke cycle phase shift.

References for Example 8 are made to FIG. 8. Sculling, as performed by a pair, is considered in Example 8. The location of the rowers is indicated by the location of the rigging 13 for each rower and the spacing between adjacent rowers is the distance between oarlock pin to oarlock pin 14 measured parallel to the lengthwise axis of the boat. In constructing FIG. 8, typical values for a men's sculling pair have been used as follows: the outboard oar length is 2.11 m and the spread is 0.79 m. The length of stroke is a 120° arc 15 with an angle of 30° to the boat's lengthwise axis at the catch and an angle of 30° to the boat's axis at the finish. In a sculling pair with unison rowing, the rowers are spaced about 1.4 m apart. To facilitate one-half stroke cycle phase shift rowing for a sculling pair, the two rowers are spaced 4.2 m apart. Numbering the rowers as one in the bow 11 and two in the stern 12, the relative positioning of the oars for one-half stroke cycle phase shift rowing is shown in FIG. 8 with the one rower in the finish position 16 of a stroke and the two rower in the catch position 17 of a stroke. The separation of rowers to facilitate one-half stroke cycle phase shift rowing in a sculling pair could be adjusted to somewhat less than 4.2 m depending on factors such as oar length, spread and length of stroke.

What is claimed is:

1. A rowing shell adapted for one of sweep rowing and scull rowing, the rowing shell comprising non-movable oarlocks mounted on gunnels and seating at least two groups of rowers in a longitudinal direction of the shell, at least one of the groups of rowers comprising two or more rowers, wherein rowers within each group are seated for rowing in phase with each other, but adjacent groups of rowers are seated for rowing out of phase with respect to each other;

a spacing between adjacent rowers within the group being about 1.4 meters, the adjacent rowers spacing being measured in the longitudinal direction between adjacent oarlock pins within the group;

a spacing between adjacent groups of rowers being about between 3.0 meters and 3.5 meters for one-half stroke cycle out of phase sweep rowing, about 2.5 meters for one-quarter stroke cycle out of phase sweep rowing, and about between 3.7 meters and 4.2 meters for one-half stroke cycle out of phase scull rowing, wherein the adjacent group spacing is measured between two proximal oarlock pins of the two adjacent groups.

2. The rowing shell of claim 1 comprising an eight person shell with sweep rowing whereby if the rowers are numbered one to eight beginning at the bow and ending at the stern, the spacing between rowers four and five is between 3.0 meters to 3.5 meters to facilitate rowers one to four rowing at one-half of a stroke cycle out of phase with rowers five to eight, where the spacing between the individual rowers numbered one to four and individual rowers numbered five to eight is about 1.4 meters to allow rowers one to four to row in phase with each other and to allow rowers five to eight to row in phase with each other.

3. The rowing shell of claim 1 comprising an eight person shell with sweep rowing whereby if the rowers are numbered one to eight beginning at the bow and ending at the stem, the spacing between rowers two and three, rowers four and five and rowers six and seven is about 2.5 meters to facilitate rowers three and four rowing at one-quarter of a stroke cycle out of phase with rowers one and two, rowers five and six rowing at one-quarter of a stroke cycle out of phase with rowers three and four and rowers seven eight rowing at one-quarter of a stroke cycle out of phase with rowers five and six, where the spacing between rowers one and two, rowers three and four, rowers five and six and rowers seven and eight is about 1.4 meters to allow rowers one and two to row in phase with each other, rowers three and four to row in phase with each other, rowers five and six to row in phase with each other and rowers seven and eight to row in phase with each other.

4. The rowing shell of claim 1 comprising a four person shell with sweep rowing whereby if the rowers are numbered one to four beginning at the bow and ending at the stern, the spacing between rowers two and three is between about 3.0 meters to 3.5 meters to facilitate rowers one and two rowing at one-half of a stroke cycle out of phase with rowers three and four, where the spacing between rowers one and two and rowers three and four is about 1.4 meters to allow rowers one and two to row in phase with each other and rowers three and four to row in phase with each other.

5. The rowing shell of claim 1 comprising a four person shell with sculling rowing, whereby if the rowers are numbered one to four beginning at the bow and ending at the stern, the spacing between rowers two and three is between about 3.7 meters to 4.2 meters to facilitate rowers one and two rowing at one-half of a stroke cycle out of phase with rowers three and four, where the spacing between rowers one and two and rowers three and four is about 1.4 meters to allow rowers one and two to row in phase with each other and rowers three and four to row in phase with each other.

* * * * *